US008141376B2

(12) United States Patent
Choi et al.

(10) Patent No.: US 8,141,376 B2
(45) Date of Patent: Mar. 27, 2012

(54) AIR CONDITIONING SYSTEM HAVING A PRESSURE COMPENSATION DEVICE

(75) Inventors: Song Choi, Seoul (KR); Baik Young Chung, Seoul (KR); Yun Ho Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 600 days.

(21) Appl. No.: 12/033,787

(22) Filed: Feb. 19, 2008

(65) Prior Publication Data

US 2008/0223065 A1 Sep. 18, 2008

(30) Foreign Application Priority Data

Mar. 15, 2007 (KR) ..... 10-2007-0025443

(51) Int. Cl.
*F25B 41/00* (2006.01)
*F25B 49/00* (2006.01)

(52) U.S. Cl. ..... 62/196.1; 62/159; 62/324.6; 62/510

(58) Field of Classification Search ..... 62/159, 62/196.1, 324.6, 498, 510
See application file for complete search history.

(56) References Cited

U.S. PATENT DOCUMENTS 5,279,131 A * 1/1994 Urushihata et al. ..... 62/324.1
2002/0035840 A1* 3/2002 Kim et al. ..... 62/199
2006/0272345 A1* 12/2006 Ueno et al. ..... 62/278
2007/0022777 A1* 2/2007 Takegami et al. ..... 62/498
2007/0137231 A1* 6/2007 Takegami et al. ..... 62/228.3
2007/0220915 A1* 9/2007 Heyl ..... 62/324.1
2008/0282728 A1* 11/2008 Takegami et al. ..... 62/498

FOREIGN PATENT DOCUMENTS

GB 2192735 A * 1/1988
JP 2001-133058 A 5/2001
JP 2007-93017 A 4/2007
KR 10-2002-0037551 A 5/2002
KR 10-2002-0037606 A 5/2002

* cited by examiner

*Primary Examiner* — Marc Norman
*Assistant Examiner* — Paolo Gonzalez
(74) *Attorney, Agent, or Firm* — Birch, Stewart, Kolasch & Birch, LLP

(57) ABSTRACT

An air conditioning system including an outdoor heat-exchanging unit, at least one indoor heat-exchanging unit, a gaseous refrigerant line connected between the outdoor heat-exchanging unit and the indoor heat-exchanging unit, to allow a refrigerant in a gaseous state to flow between the outdoor heat-exchanging unit and the indoor heat-exchanging unit, and a pressure compensation device for increasing a pressure of the gaseous refrigerant flowing through the gaseous refrigerant line. The pressure compensation device is located along the gaseous refrigerant line at a position closer to the indoor heat-exchanging unit than to the outdoor heat-exchanging unit. A pressure compensation device for use in an air conditioning system is also provided.

10 Claims, 5 Drawing Sheets

AIR CONDITIONING SYSTEM HAVING A PRESSURE COMPENSATION DEVICE

CROSS-REFERENCE TO RELATED APPLICATIONS

This application claims the benefit of Korean Patent Application No. 10-2007-0025443, filed on Mar. 15, 2007, which is hereby incorporated by reference in its entirety.

BACKGROUND OF THE INVENTION

1. Field of the Invention

The present invention relates to an air conditioning system and a control method thereof, and more particularly to an air conditioning system and a control method thereof which are capable of compensating for pressure drop of a refrigerant in a line connecting an outdoor unit and one or more indoor units.

2. Description of Related Art

Generally, air conditioning systems are used to cool or heat confined spaces, for example, rooms in a building. In such an air conditioning system, a refrigerant is circulated between an indoor unit and an outdoor unit such that the refrigerant absorbs ambient heat while evaporating from a liquid phase, and discharges the absorbed heat while condensing from a gaseous phase. In accordance with such characteristics of the refrigerant, the air conditioning system performs a cooling or heating operation.

In a typical air conditioning system, one indoor unit is installed for one outdoor unit. However, recently, the use of an air conditioning system in the form of a multi-system air conditioner has increased. In a multi-system air conditioner, a plurality of indoor units having various structures and various capacities are connected to one or more outdoor units, in order to perform a cooling or heating operation for an area where there are a plurality of separated spaces, as in a school, a company, or a hospital.

FIG. 1 is a block diagram illustrating the configuration of a multi-system air conditioner. For the convenience of explanation, the situation, in which the air conditioning system is used to cool spaces, will be first described.

The conventional multi-system air conditioner includes an outdoor unit 10 and a plurality of indoor units 20 connected to the outdoor unit 10. The outdoor unit 10 includes a compressor for compressing a gaseous refrigerant emerging from the indoor units 20 after performing heat exchange in the indoor units 20, and an outdoor heat exchanger for transferring heat in the refrigerant to ambient air. Each indoor unit 20 includes an indoor heat exchanger. The conventional multi-system air conditioner also includes a gaseous refrigerant line 30 and a liquid refrigerant line 40 connected between the outdoor unit 10 and the indoor units 20, to transfer the refrigerant while in a gaseous phase and a liquid phase, respectively.

The multiple indoor units 20 of the above-mentioned multi-system air conditioner are connected to the outdoor unit 10 via lines branched from the outdoor unit 10, and are installed in one or more stories of a multi-story building, or in other separated spaces. In this multi-system air conditioner, the refrigerant is sent from the outdoor unit 10 to each indoor unit 20 via the gaseous refrigerant line 30 after being compressed in the outdoor unit 10 and returned to the outdoor unit via the liquid refrigerant line 40.

In accordance with the above-mentioned arrangement, the refrigerant circulating through the multi-system air conditioner forms a repetitive cycle of evaporation—compression—condensation—expansion, in which the refrigerant absorbs heat in the indoor heat exchanger of each indoor unit 20, through an evaporation process, is compressed in the compressor of the outdoor unit 10, is condensed, and is then expanded through an expansion valve.

When the air conditioning system is used to heat rooms, the cooling cycle of the air conditioning system is reversed. That is, the refrigerant absorbs heat in the heat exchanger of the outdoor unit 10, and discharges the absorbed heat through the heat exchanger of each indoor unit 20 installed in a room. Thus, the air conditioning system can absorb heat from a low-temperature area, namely, the outdoors, and can use the absorbed heat in order to heat rooms. When the absorbed heat is insufficient to heat rooms, it may be possible to heat the rooms using an electric heater, together with the absorbed heat.

In either case, the gaseous refrigerant line 30 and the liquid refrigerant line 40, which connect the outdoor unit 10 and the indoor units 20, are provided. However, when the refrigerant is evaporated in accordance with an evaporation function, there may be a problem in that a pressure drop of the evaporated gaseous refrigerant occurs in the gaseous refrigerant line 30, through which the gaseous refrigerant flows.

In an air conditioning system such as a multi-system air conditioner, when the number of indoor units 20 connected to one outdoor unit 10 increases and/or the distance of each indoor unit 20 from the outdoor unit 10 increases, the length of the refrigerant line correspondingly increases. However, such an increase in the length of the refrigerant line causes an increase in the resistance applied to the refrigerant flowing through the refrigerant line. In particular, the internal pressure of the gaseous refrigerant line 30, through which a gaseous refrigerant flows, may drop.

The performance of the air conditioning system is proportional to the circulation flow rate of the heat-exchangeable refrigerant. Consequently, a pressure drop of the gaseous refrigerant in the gaseous refrigerant line 30 decreases the circulation flow rate of the refrigerant, thereby degrading the efficiency and performance of the refrigerant cycle. Furthermore, since the refrigerant cannot smoothly flow, noise may be generated in the refrigerant line.

BRIEF SUMMARY OF THE INVENTION

Accordingly, the present invention is directed to an air conditioning system and a control method thereof that substantially obviate one or more problems due to limitations and disadvantages of the related art.

An object of the present invention is to provide an air conditioning system and a control method thereof which are capable of compensating for the pressure drop of a refrigerant in a line connecting an outdoor unit and a plurality of indoor units.

To achieve these objects and other advantages and in accordance with the purpose of the invention, as embodied and broadly described herein, an air conditioning system is provided. The air conditioning system includes an outdoor heat-exchanging unit, at least one indoor heat-exchanging unit, a gaseous refrigerant line connected between the outdoor heat-exchanging unit and the indoor heat-exchanging unit, to allow a refrigerant in a gaseous state to flow between the outdoor heat-exchanging unit and the indoor heat-exchanging unit, and a pressure compensation device for increasing a pressure of the gaseous refrigerant flowing through the gaseous refrigerant line. The pressure compensation device is located along the gaseous refrigerant line at a position closer to the indoor heat-exchanging unit than to the outdoor heat-exchanging unit.

In another aspect, the pressure compensation device may include a sub-compressor having an inlet and an outlet, the sub-compressor being configured to compress the gaseous refrigerant flowing through the gaseous refrigerant line, and a flow controller to guide the gaseous refrigerant to the inlet of the sub-compressor.

In a further aspect, the flow controller may include a guide line branched from the gaseous refrigerant line, the guide line configured to guide a flow of the gaseous refrigerant, a valve to control a gaseous refrigerant flow in the guide line, and a valve controller to control opening and closing of the valve.

In another aspect, the gaseous refrigerant line may include a first gaseous refrigerant line connected to the inlet of the sub-compressor, and a second gaseous refrigerant line connected to the outlet of the sub-compressor.

In a different aspect, the guide line may include a first guide line connected to the first gaseous refrigerant line at one end of the first guide line and connected to the second gaseous refrigerant line at the other end of the first guide line, and a second guide line connected to the first gaseous refrigerant line at one end of the second guide line and connected to the second gaseous refrigerant line at the other end of the second guide line. The second guide line may be independent of the first guide line.

In yet another aspect, the valve may include a bypass valve arranged in the guide line, and a flow control valve arranged in the gaseous refrigerant line. In addition, the bypass valve may include a first bypass valve arranged in the first guide line, and a second bypass valve arranged in the second guide line. The flow control valve may include a first flow control valve arranged in the first gaseous refrigerant line, and a second flow control valve arranged in the second gaseous refrigerant line.

In still a further aspect, the first flow control valve may be arranged in the first gaseous refrigerant line between a point where the first gaseous refrigerant line is connected with the first guide line and a point where the first gaseous refrigerant line is connected with the second guide line, and the second flow control valve may be arranged in the second gaseous refrigerant line between a point where the second gaseous refrigerant line is connected with the first guide line and a point where the second gaseous refrigerant line is connected with the second guide line.

In another aspect, when the air conditioning system is in a heating operation mode, the valve controller may close the first and second bypass valves, while opening the first and second flow control valves, to allow the gaseous refrigerant to flow in a direction from the outdoor unit to the indoor unit. And when the air conditioning system is in a cooling operation mode, the valve controller may open the first and second bypass valves, while closing the first and second flow control valves, to allow the gaseous refrigerant to flow in a direction from the indoor unit to the outdoor unit.

In still another aspect, the pressure compensation device may include a case forming an appearance of the pressure compensation device, and the case receives a portion of the gaseous refrigerant line.

In a further aspect, the air conditioning system may include a liquid refrigerant line connected between the outdoor heat-exchanging unit and the indoor heat-exchanging unit, to allow the refrigerant in a liquid state to flow between the outdoor heat-exchanging unit and the indoor heat-exchanging unit, and the liquid refrigerant line may be located outside the case.

In yet another aspect, the flow controller may control the gaseous refrigerant to flow through the sub-compressor in a single direction, irrespective of a variation in a flow direction of the refrigerant according to an operation mode change between a cooling operation mode and a heating operation mode.

In yet another aspect, the outdoor heat-exchanging unit may include a main compressor for compressing the refrigerant. The pressure compensation device may include a sub-compressor arranged in the gaseous refrigerant line, to additionally compress the gaseous refrigerant flowing through the gaseous refrigerant line. The air conditioning system may also include a guide line for guiding the gaseous refrigerant to an inlet of the sub-compressor.

In a further aspect, the guide line may include at least two bypass lines arranged to cross each other with respect to the sub-compressor.

According to principles of the present invention, an air conditioning system is provided that includes an outdoor heat-exchanging unit, a gaseous refrigerant line connected to the outdoor heat-exchanging unit to allow a refrigerant in a gaseous state to flow therein, a pressure compensation device for increasing a pressure of the gaseous refrigerant flowing through the gaseous refrigerant line, the gaseous refrigerant line being connected between the outdoor heat-exchanging unit and the pressure compensation device, and a first indoor heat-exchanging unit connected to a portion of the gaseous refrigerant line extending between the outdoor heat-exchanging unit and the pressure compensation device.

In another aspect, the air conditioning system may include a second indoor heat-exchanging unit, and the pressure compensation device may be located along the gaseous refrigerant line at a position between the first indoor heat-exchanging unit and the second indoor heat-exchanging unit.

Other aspects of the air conditioning system are similar to those described above.

According to principles of the present invention, a pressure compensation device for use in an air conditioning system having an outdoor heat-exchanging unit including a main compressor for compressing a refrigerant flowing in a gaseous refrigerant line, the refrigerant flowing in a first direction when the air conditioning system is in a cooling mode, and the refrigerant flowing in a second opposite direction when the air conditioning system is in a heating mode, is provided. The pressure compensation device may include a sub-compressor locatable in the gaseous refrigerant line, and adapted to additionally compress the refrigerant flowing through the gaseous refrigerant line. A valve arrangement configured to permit the refrigerant to flow through the sub-compressor in a first direction when the air conditioning system is in a cooling mode and the refrigerant is flowing in the first direction, and to permit the refrigerant to flow through the sub-compressor in the first direction when the air conditioning system is in a heating mode and the refrigerant is flowing in the second direction, may also be provided.

Other features of the pressure compensation device are similar to those features described above.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. It is to be understood that both the foregoing general description and the following detailed description of the present invention are exemplary and explanatory and are intended to provide her explanation of the invention as claimed.

BRIEF DESCRIPTION OF THE DRAWINGS

The accompanying drawings, which are included to provide a further understanding of the invention and are incorporated in and constitute a part of this application, illustrate exemplary embodiments of the invention and together with the description serve to explain the principle of the invention. In the drawings.

DETAILED DESCRIPTION OF THE INVENTION

Reference will now be made in detail to exemplary embodiments of the present invention, examples of which are illustrated in the accompanying drawings. Wherever possible, the same reference numbers will be used throughout the drawings to refer to the same or like parts.

Figure 1:
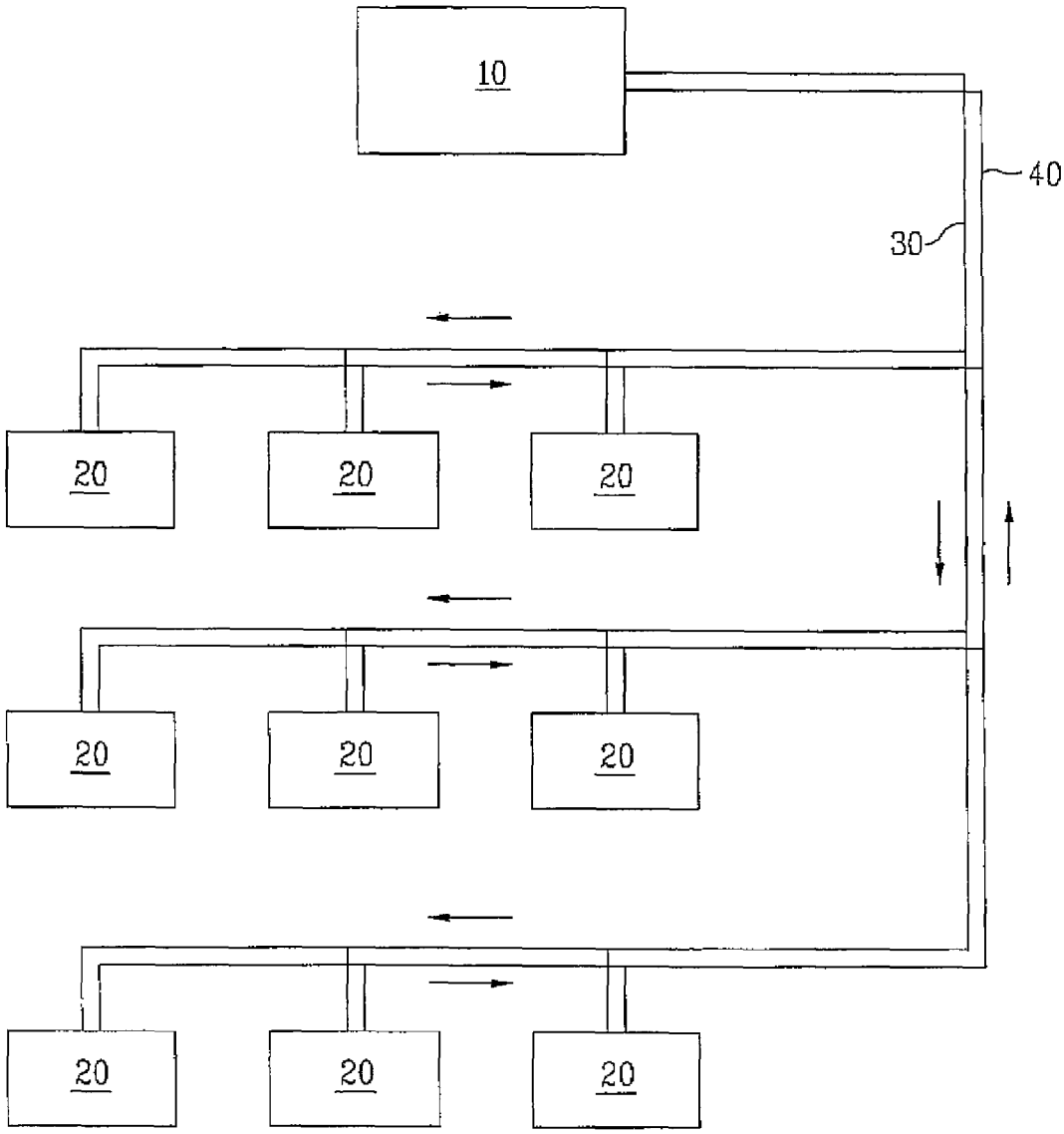
FIG. 1 PRIOR ART
FIG. 1 is a block diagram illustrating the configuration of a related art air conditioning system.
Figure 2:
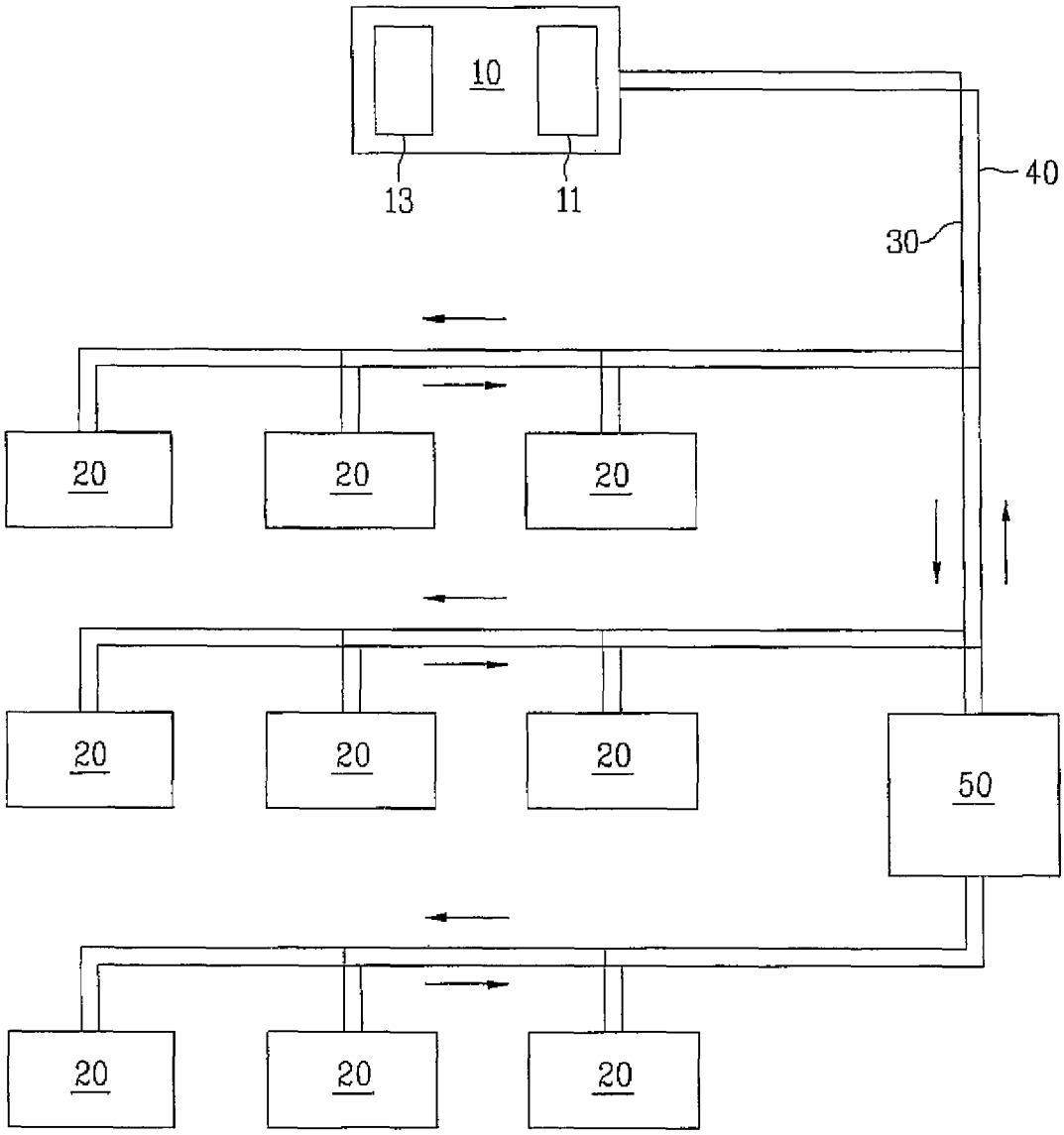
FIG. 2 is a block diagram illustrating the configuration of an air conditioning system according to the present invention.

As seen in FIG. 2, an exemplary embodiment of an air conditioning system includes at least one outdoor unit 10 for heat-exchanging a refrigerant with ambient air, a gaseous refrigerant line 30 extending between the outdoor unit 10 and the indoor units 20, to allow a gaseous refrigerant to flow between the outdoor unit 10 and the indoor units 20 through the gaseous refrigerant line 30, and a liquid refrigerant line 40 extending between the outdoor unit 10 and the indoor units 20, to allow a liquid refrigerant to flow between the outdoor unit 10 and the indoor units 20 through the liquid refrigerant line 40. The air conditioning system also includes a pressure compensation device 50 for increasing the pressure of the refrigerant flowing through the gaseous refrigerant line 30.

When the air conditioning system is used to cool rooms, the refrigerant is evaporated in each indoor unit 20 by absorbing heat from ambient air around the indoor unit 20. The evaporated gaseous refrigerant is then compressed in the outdoor unit 10.

The outdoor unit 10 includes an outdoor heat exchanger 11 for heat-exchanging the refrigerant with outdoor air, and a main compressor 13. Each indoor unit 20 includes an indoor heat exchanger (not shown) for heat-exchanging the refrigerant with indoor air. While the present embodiment shows the main compressor 13 and the outdoor heat exchanger 11 located in a single structure, it is understood that the outdoor heat exchanger 11 and the main compressor 13 could be provided in separate structures and may be spaced from each other.

In the following description, it is assumed that the outdoor unit 10 includes a main compressor and an outdoor heat exchanger as described above, and each indoor unit 20 includes an indoor heat exchanger as described above. In a cooling operation, the gaseous refrigerant in the gaseous refrigerant line 30 flows from each indoor unit 20 to the outdoor unit 10. In a heating operation, the gaseous refrigerant in the gaseous refrigerant line 30 flows from the outdoor unit 10 to each indoor unit 20.

The pressure compensation device 50 is adapted to compensate for a refrigerant pressure drop in the gaseous refrigerant line 30, through which the gaseous refrigerant flows, regardless of whether the air conditioner system is performing a heating or cooling operation. Since the pressure drop occurs because the gaseous refrigerant line 30 connecting the indoor units 20 and the outdoor unit 10 is long, whether because of the number of indoor units 20 provided and/or the distance between the indoor units 20 and the outdoor unit 10, it is preferred that the pressure compensation device 50 be installed near the indoor unit 20 spaced apart from the outdoor unit 10 by a longer distance. In other words, the pressure compensation device 50 is located closer to the indoor unit 20 than to the outdoor unit 10.

In the following description, the pressure compensation device 50 will be given in conjunction with only the indoor unit 20 arranged near the pressure compensation device 50. The installation position of the pressure compensation device 50 should be appropriately determined in accordance with detailed conditions of the air conditioning system. For example, while the pressure compensation device 50 has been shown as being located between indoor units 20, it is understood that the pressure compensation device 50 could be placed in various locations in the system including before the first indoor unit 20 if the distance between the outdoor unit 10 and the first indoor unit 20 is too far apart.

Figure 3A:
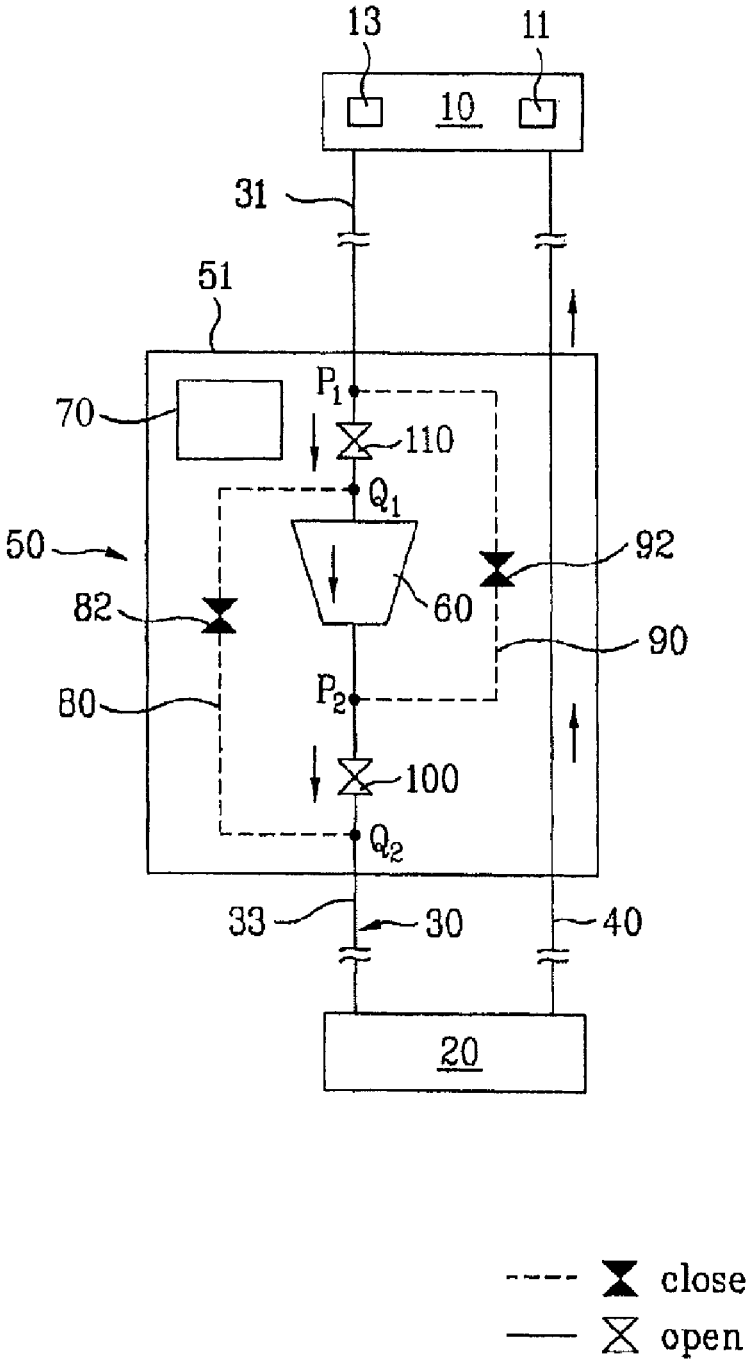
FIG. 3A is a diagram illustrating a refrigerant flow through a pressure compression device during a heating operation of the air conditioning system according to the present invention.
Figure 3B:
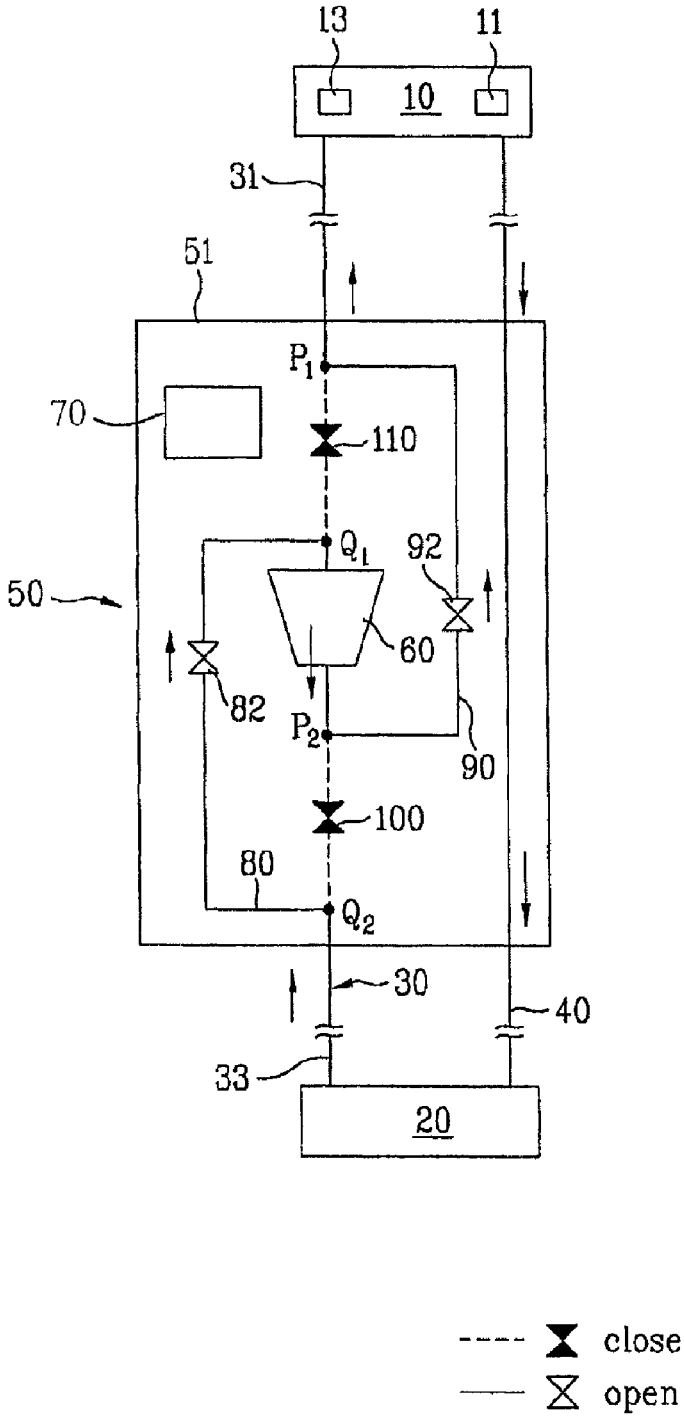
FIG. 3B is a diagram illustrating a refrigerant flow through the pressure compression device during a cooling operation of the air conditioning system according to the present invention.
Figure 4:
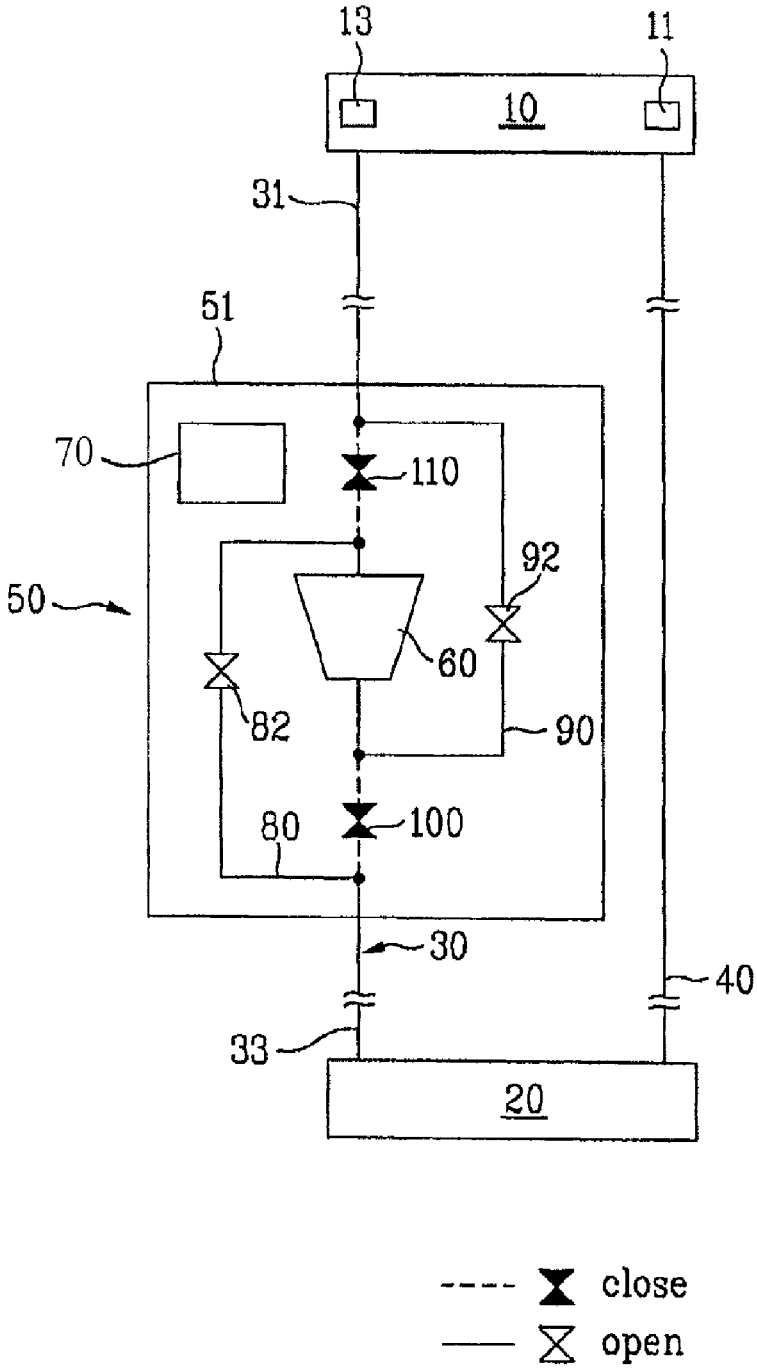
FIG. 4 is a diagram illustrating a pressure compensation device having another configuration according to the present invention.

As seen in FIGS. 3A and 3B, the pressure compensation device 50 includes a sub-compressor 60 for compressing the refrigerant flowing through the gaseous refrigerant line 30, and a flow controller for guiding the refrigerant to an inlet of the sub-compressor 60. The pressure compensation device 50 may further include a case 51 forming the appearance of the pressure compensation device 50, and receiving a portion of the gaseous refrigerant line 30 and a portion of the liquid refrigerant line 40. It is possible for the liquid refrigerant line 40 to be arranged outside the case 51, as seen in FIG. 4.

The sub-compressor 60 is distinct from the main compressor 13 included in the outdoor unit 10 and is installed separately from the main compressor 13. As such, the sub-compressor 60 and the main compressor 13 may be provided in different locations and may be separated by a large distance. As used herein, large distance is defined as being equal to or greater than the distance between floors of a building or at least ten feet. The flow controller controls the gaseous refrigerant to flow through the sub-compressor 60 in a constant or single direction, irrespective of a variation in the flow direction of the refrigerant according to a change in operation mode between the cooling operation and the heating operation.

The flow controller may include guide lines branched from the gaseous refrigerant line 30, to guide a flow of the refrigerant, valves for controlling refrigerant flows in the guide lines, and a valve controller 70 for controlling opening or closing of the valves. In particular, the guide lines may include a first guide line 80 connected to a first gaseous refrigerant line 31 at one end of the first guide line 80, and connected to a second gaseous refrigerant line 33 at the other end of the first guide line 80, and a second guide line 90 connected to a first gaseous refrigerant line 31 at one end of the second guide line 90, and connected to a second gaseous refrigerant line 33 at the other end of the second guide line 90. The first and second guide lines 80 and 90 are independent of each other.

The first gaseous refrigerant line 31 is a gaseous refrigerant line connecting the inlet of the sub-compressor 60 and the outdoor unit 10. The second gaseous refrigerant line 33 is a gaseous refrigerant line connecting an outlet of the sub-compressor 60 and the indoor unit 20.

The valves may include bypass valves arranged in the guide lines 80 and 90, respectively, and flow control valves arranged in the gaseous refrigerant lines 31 and 33, respectively. In particular, the bypass valves may include a first bypass valve 82 arranged in the first guide line 80 and a second bypass valve 92 arranged in the second guide line 90. The flow control valves may include a first flow control valve 110 arranged in the first gaseous refrigerant line 31 and a second flow control valve 100 arranged in the second gaseous refrigerant line 33. While the valves have been described as flow valves and bypass valves, these descriptions relate to the functions they perform in the air conditioning system and they are not limited to particular types of the valves so long as the valves can be opened and controlled by the valve controller 70.

The first flow control valve 110 is arranged in the first gaseous refrigerant line 31 between a point Q1 where the first gaseous refrigerant line 31 is connected with the first guide line 80 and a point P1 where the first gaseous refrigerant line 31 is connected with the second guide line 90. The second flow control valve 100 is arranged in the second gaseous refrigerant line 33 between a point Q2 where the second gaseous refrigerant line 33 is connected with the first guide line 80 and a point P2 where the second gaseous refrigerant line 33 is connected with the second guide line 90.

In a heating operation mode, the valve controller 70 closes the first and second bypass valves 82 and 92, while opening the first and second flow control valves 110 and 100, in order to allow the gaseous refrigerant to flow in a direction from the outdoor unit 10 to the indoor unit 20. In a cooling operation mode, the valve controller 70 opens the first and second bypass valves 82 and 92, while closing the first and second flow control valves 110 and 100, in order to allow the gaseous refrigerant to flow in a direction from the indoor unit 10 to the indoor unit 20. In a cooling operation mode, the value controller 70 opens the first and second bypass value 82 and 92, while closing the first and second flow control values 110 and 100, in order to allow the gaseous refrigerant to flow in a direction from the indoor unit 20 to the outdoor unit 10.

In particular, when the air conditioning system according to this exemplary embodiment is used for a heating purpose, a gaseous refrigerant flows from the outdoor unit 10 to the indoor unit 20, as seen in FIG. 3A. In this case, the pressure compensation device 50 compensates for a pressure drop of the gaseous refrigerant flowing from the outdoor unit 10 to the indoor unit 20. As a result, it is possible to smoothly send the gaseous refrigerant discharged from the outdoor unit 10 to a plurality of indoor units 20. Alternatively, when the air conditioning system according to the present invention is used for a cooling purpose, a liquid refrigerant is evaporated in the indoor unit 20, and then flows to the outdoor unit 10, as shown in FIG. 3B.

Thus, when the air conditioning system is used for both the cooling purpose and the heating purpose, the flow direction of the gaseous refrigerant through the pressure compensation device 50 is variable, while maintaining a single direction of flow through the sub-compressor 60. As noted, compensation for a pressure drop in the gaseous refrigerant is achieved by compressing the gaseous refrigerant using the sub-compressor 60, to increase the pressure of the gaseous refrigerant. For such a compressor, many different types of compressors may by used including a displacement compressor and a centrifugal compressor. The displacement compressor may be a reciprocating type, a rotary type, a screw type, a scroll type, or a linear type displacement compressor. A turbo compressor is an example of a suitable centrifugal compressor, but is not limited thereto. A sub-compressor of an appropriate type may be selected in accordance with the air conditioning load and application. Generally, compressors are unidirectional. That is, in principle, compressors can compress a fluid only in a single direction, and cannot compress the fluid in a reverse direction.

Since the air conditioning system according to the exemplary embodiment can perform both a cooling operation and a heating operation for spaces to be air-conditioned, as described above, the flow direction of the refrigerant in the gaseous refrigerant line is reversed between the cooling operation and the heating operation. Accordingly, the sub-compressor 60 of the pressure compensation device 50 should be configured to meet the variable flow direction of the gaseous refrigerant as described above.

Hereinafter, the procedure for compressing the gaseous refrigerant flowing through the pressure compensation device 50 in the situation, in which the flow direction of the gaseous refrigerant is variable, will be described with reference to FIGS. 3A and 3B.

FIG. 3A illustrates the flow direction of the gaseous refrigerant when the air conditioning system according to the exemplary embodiment is used for a heating purpose. The gaseous refrigerant is introduced into the sub-compressor 60 in a direction from the outdoor unit 10 to the indoor unit 20, and is supplied to the indoor unit 20 after being compressed by the sub-compressor 60. In this arrangement, no gaseous refrigerant flows through the first and second guide lines 80 and 90. That is, in a heating operation, the gaseous refrigerant is introduced into the inlet of the sub-compressor 60 without passing through the guide lines 80 and 90, and is supplied to the indoor unit 20 via the gaseous refrigerant line after being compressed by the sub-compressor 60.

In the illustrated embodiment of the present invention, the bypass valves 82 and 92 are arranged in the guide lines 80 and 90, respectively, to control refrigerant flows passing through the guide lines 80 and 90. That is, when the first and second bypass valves 82 and 92 are maintained in a closed state, the gaseous refrigerant supplied from the outdoor unit 10 is supplied to the sub-compressor 60 without changing the flow direction. As the gaseous refrigerant supplied to the sub-compressor 60 is compressed in accordance with a compression operation of the sub-compressor 60, the pressure of the gaseous refrigerant increases.

When the air conditioning system according to the exemplary embodiment is used to cool rooms, the closed state of the first and second bypass valves 82 and 92 are opened and the flow control valves 100 and 110 are closed, as shown in FIG. 3B. In this arrangement, the gaseous refrigerant flows through the guide lines 80 and 90. In particular, the gaseous refrigerant, which is supplied from the indoor unit 20 to the pressure compensation device 50, passes through the first guide line 80 so that it is guided to the inlet of the sub compressor 60. The gaseous refrigerant emerging from the first guide line 80 is supplied to the inlet of the sub-compressor 60, and is introduced into the first gaseous refrigerant line 30 via the second guide line 90 after being compressed by the sub-compressor 60. The gaseous refrigerant then flows to the outdoor unit 10.

During the cooling operation, the first flow control valve 110 closes the second gaseous refrigerant line 33, in order to prevent the gaseous refrigerant emerging from the indoor unit 10 from being introduced into the outlet of the sub-compressor 60. As a result, the gaseous refrigerant flows through the first guide line 80. The gaseous refrigerant emerging from the first guide line 80 is introduced into the inlet of the sub-compressor 60 because the second flow control valve 100 is also maintained in a closed state. The gaseous refrigerant compressed in the sub-compressor 60 flows through the second guide line 90, and enters the outdoor unit 10 after flowing through the first gaseous refrigerant line 31.

Thus, the air conditioning system according to the present invention can compensate for a pressure drop of the gaseous refrigerant, irrespective of the flow direction of the gaseous refrigerant in the gaseous refrigerant line 30. The control for the flow direction of the gaseous refrigerant can be electronically achieved using the valve controller 70 included in the air conditioning system.

When the user sets a target temperature for a room to be air-conditioned, the set temperature may be compared with a temperature measured by the indoor unit 20 installed in the room, to determine whether the room is to be cooled or heated. Based on the results of the determination, opening or closing of the first bypass valve 82, second bypass valve 92, first flow control valve 100, and second flow control valve 110 can be determined.

For example, when the air conditioning system operates in a cooling mode to cool the room or in a heating mode to heat the room, the pressure compensation device operates to increase the pressure of the gaseous refrigerant during the cooling or heating operation. The operation of the pressure compensation device is achieved by controlling the valves arranged in the guide lines adapted to guide the flow of the gaseous refrigerant and the valves arranged in the gaseous refrigerant lines. As a result, the flow direction of the gaseous refrigerant in the sub-compressor included in the pressure compensation device is constant.

The pressure compensation device 50 has design flexibility so that the installation position of the pressure compensation device 50 is accommodating of other system constraints. This X means that, if necessary, the liquid refrigerant line 40 can be separated from the pressure compensation device 50 such that it can be installed outside the case 51, as seen in FIG. 4. Under the condition in which the lines of the air conditioning system, namely, the gaseous refrigerant line 30 and the liquid refrigerant line 40, should be separate from each other, it is possible to separate the liquid refrigerant line 40 from the pressure compensation device 50.

In accordance with the addition of the pressure compensation device 50 to the air conditioning system, it is possible to compensate for a refrigerant pressure drop in the gaseous refrigerant line 30 spaced apart from the outdoor unit 10 by a long distance. In accordance with this pressure drop compensation, it is possible to smoothly circulate the refrigerant through the indoor units 20 and outdoor unit 10, irrespective of the lengths of the lines 30 and 40.

As the circulation of the refrigerant becomes smooth, it is possible to achieve a constant flow rate of the refrigerant in the gaseous refrigerant line 30. Accordingly, it is also possible to reduce noise generated in the line due to an irregular refrigerant flow.

The air conditioning system according to the present invention can achieve an enhancement in cooling or heating efficiency because it includes a pressure compensation device capable of compensating for a pressure drop of a gaseous refrigerant in a refrigerant line of the air conditioning system. Also, it is possible to reduce nose generated due to a pressure drop of a gaseous refrigerant in a gaseous refrigerant line.

In accordance with the present invention, the gaseous refrigerant flows through a sub-compressor of the pressure compensation device in a constant direction. Accordingly, there is an advantage in that it is possible to compensate for the pressure drop of the gaseous refrigerant, irrespective of the operation mode of the air conditioning system.

It will be apparent to those skilled in the art that various modifications and variations can be made in the present invention without departing from the spirit or scope of the inventions, such as, but not limited thereto, the plurality of valves may be replaced with another valve arrangement including a reversing valve. Thus, it is intended that the present invention covers the modifications and variations of this invention provided they come within the scope of the appended claims and their equivalents.

What is claimed:

1. An air conditioning system comprising:

an outdoor heat-exchanging unit having an outdoor heat exchanger and a main compressor;

at least one indoor heat-exchanging unit having an indoor heat exchanger;

a gaseous refrigerant line connected between the outdoor heat-exchanging unit and the indoor heat-exchanging unit, to allow a refrigerant in a gaseous state to flow between the outdoor heat-exchanging unit and the indoor heat-exchanging unit, the gaseous refrigerant line including a first gaseous refrigerant line connected to the outdoor heat-exchanging unit and a second gaseous refrigerant line connected to the indoor heat-exchanging unit;

a liquid refrigerant line connected between the outdoor heat-exchanging unit and the indoor heat-exchanging unit, the liquid refrigerant line being separate from the gaseous refrigerant line; and a pressure compensation device for increasing a pressure of the gaseous refrigerant flowing through the gaseous refrigerant line, the pressure compensation device including:

a sub-compressor having an inlet and an outlet, the sub-compressor being configured to compress the gaseous refrigerant flowing through the gaseous refrigerant line, the first gaseous refrigerant line being connected to the inlet of the sub-compressor, and the second gaseous refrigerant line being connected to the outlet of the sub-compressor;

a first guide line connected to the first gaseous refrigerant line at one end of the first guide line and connected to the second gaseous refrigerant line at the other end of the first guide line;

a second guide line connected to the first gaseous refrigerant line at one end of the second guide line and connected to the second gaseous refrigerant line at the other end of the second guide line;

a first flow control valve arranged in the first gaseous refrigerant line;

a second flow control valve arranged in the second gaseous refrigerant line;

a first bypass valve arranged in the first guide line;

a second bypass valve arranged in the second guide line; and a valve controller configured to control the first bypass valve, the second bypass valve, the first flow control valve, and the second flow control valve to control refrigerant flow through the first and second guide lines to guide gaseous refrigerant to the inlet of the sub-compressor, wherein the first flow control valve is arranged in the first gaseous refrigerant line between a point where the first gaseous refrigerant line is connected with the first guide line and a point where the first gaseous refrigerant line is connected with the second guide line, and the second flow control valve is arranged in the second gaseous refrigerant line between a point where the second gaseous refrigerant line is connected with the first guide line and a point where the second gaseous refrigerant line is connected with the second guide line.

2. The air conditioning system according to claim 1, wherein the second guide line is independent of the first guide line.

3. The air conditioning system according to claim 1, wherein, in a heating operation mode, the valve controller closes the first and second bypass valves, while opening the first and second flow control valves, to allow the gaseous refrigerant to flow in a direction from the outdoor unit to the indoor unit.

4. The air conditioning system according to claim 1, wherein, in a cooling operation mode, the valve controller opens the first and second bypass valves, while closing the first and second flow control valves, to allow the gaseous refrigerant to flow in a direction from the indoor unit to the outdoor unit.

5. The air conditioning system according to claim 1, wherein the pressure compensation device further includes a case forming an appearance of the pressure compensation device, and the case receives a portion of the gaseous refrigerant line.

6. The air conditioning system according to claim 1, wherein the pressure compensation device controls the gaseous refrigerant to flow through the sub-compressor in a single direction, irrespective of a variation in a flow direction of the refrigerant according to an operation mode change between a cooling operation mode and a heating operation mode.

7. The air conditioning system according to claim 1, wherein the at least one indoor heat-exchanging unit is an air conditioner for cooling a room.

8. The air conditioning system according to claim 7, wherein, in a cooling operation mode, the air condition is located directly upstream from the pressure compensation device.

9. The air conditioning system according to claim 8, wherein, in a heating operation mode, the air conditioner is located directly downstream from the pressure compensation device.

10. The air conditioning system according to claim 7, wherein, in a heating operation mode, the air conditioner is located directly downstream from the pressure compensation device.

* * * * *